United States Patent [19]

Giori et al.

[11] Patent Number: 4,766,809

[45] **Date of Patent: * Aug. 30, 1988**

[54] MULTICOLOR PERFECTING PRESS

[75] Inventors: Gualtiero Giori, Lonay; Manuel Hernandez, Lausanne, both of Switzerland

[73] Assignee: De La Rue Giori S.A., Lausanne, Switzerland

[ * ] Notice: The portion of the term of this patent subsequent to Mar. 11, 2003 has been disclaimed.

[21] Appl. No.: 806,617

[22] Filed: Dec. 9, 1985

Related U.S. Application Data

[63] Continuation-in-part of Ser. No. 622,986, Jun. 21, 1984, Pat. No. 4,574,696.

[30] Foreign Application Priority Data

Dec. 18, 1984 [CH] Switzerland ..... 5988/84
Oct. 15, 1985 [CH] Switzerland ..... 4438/85

[51] Int. Cl.[4] ..... B41F 5/16

[52] U.S. Cl. ..... 101/152; 101/176; 101/177; 101/179

[58] Field of Search ..... 101/152, 179, 177, 175, 101/176

[56] References Cited

U.S. PATENT DOCUMENTS 4,056,056 11/1977 Giori ..... 101/152
4,441,423 4/1984 Germann ..... 101/177 X
4,516,496 5/1985 Giori ..... 101/152
4,574,696 3/1986 Giori ..... 101/152

FOREIGN PATENT DOCUMENTS 92887 11/1983 European Pat. Off. ..... 101/177
132858 2/1985 European Pat. Off. ..... 101/177
132859 2/1985 European Pat. Off. ..... 101/177
2094717 9/1982 United Kingdom ..... 101/177

*Primary Examiner*—Clifford D. Crowder
*Attorney, Agent, or Firm*—Kane, Dalsimer, Sullivan, Kurucz, Levy, Eisele and Richard

[57] ABSTRACT

According to the machine and method, one of the paper sides is printed with a collect print image with juxtaposed colors by means of a typographic plate cylinder inked by a collecting cylinder inked in turn by selective color inking cylinders of which the number corresponds to the number of colors, and on the other side an image with superposed colors and designs by means of offset plate cylinders contacting an offset blanket cylinder and of which the number corresponds to the number of colors and designs of the image. For this purpose the machine comprises another blanket cylinder contacting the typographic plate cylinder and pressed against the offset blanket cylinder, the paper passes between this cylinder and the other blanket cylinder. The multicolor collect print side may be completed by at least one monochrome wet offset print. In additional embodiments, the geometrical arrangement of the blanket cylinders is changed to enable additional printing units to contact the other blanket cylinder. Moreover the typographic plate cylinder may be converted to an image transfer cylinder, while the selective color inking cylinders are converted to offset plate cylinders.

22 Claims, 5 Drawing Sheets

MULTICOLOR PERFECTING PRESS

This is a continuation-in-part of U.S. Patent application Ser. No. 622,986, currently U.S. Pat. No. 4,574,696, issued on Mar. 11, 1986.

FIELD OF INVENTION

The invention relates to a rotary press for the simultaneous multicolor printing of both sides of a web or sheet and to a method of printing.

PRIOR ART

A machine is already known through the published German Patent application (DE-A-No. 3,109,964), corresponding to U.S. Pat. No. 4,441,423 issued to Germann on Apr. 10, 1984, which performs on one side of the paper the printing of an image with juxtaposed colors. This image is printed by means of a single typographic printing plate representing the complete design to be printed and mounted on a plate cylinder. This typographic plate is inked by a collecting device consisting of a blanket cylinder inked in turn by a plurality of selective color inking cylinders of which the number corresponds to the image to be printed. Each selective inking cylinder comprises relief cut areas representing the image portions to be colored in a predetermined color transferred thereto by its inherent inking device. This machine is intended notably for printing the safety background of bank notes.

With this method, currently referred to as the "Orlof" or color collecting printing method, a multicolor image is obtained which ensures a perfect registration between the different colors of the image design, a result that cannot be obtained with any other printing method. Since the selective color inking cylinders are in contact with a resilient surface of the collecting cylinder, they can be manufactured from hard material so that areas having a very fine relief, and therefore very fine colored portions, for example in the form of lines or points, can be obtained.

On the other hand, offset or indirect typographic printing with superposed colors and design is also known which, likewise, is frequently utilized for printing safety backgrounds. According to this method, the complete design consists of partial designs in different colors carried by offset printing plates mounted on plate cylinders to permit the superposition of designs and colors registering with one another on a blanket cylinder against which the paper to be printed is pressed. The number of offset printing plates and consequently of plate cylinders corresponds to the number of different colors and designs constituting the multicolor image.

Machines of this type are also known for the simultaneous printing on both sides, wherein the paper passes between two blanket cylinders receiving each a multicolor image from the corresponding offset plate cylinders.

In the present state of the art machines have been developed which exploit separately one or the other of the above-described methods.

Moreover in the present state of the art, the number of colors that can be transferred by these printing machines on one side of the paper was as a rule limited to four. This is due notably to a problem of space available around the cylinder, this space preventing the use of more than four inking systems per cylinder. On the other hand, with offset printing if an excessive number of superposed ink layers of different colors is used, the total thickness of the layer increases and is detrimental to the quality of the transferred image; it was even found that beyond four colors the ink film is too thick and the contact between the blanket cylinder and the next offset plate is liable to partially tear off the previously applied ink film instead of applying the new film.

SUMMARY OF THE INVENTION

It is the object of this invention to provide a single and same machine combining in a simultaneous recto and verso printing the two above-described methods and referred to hereinafter as the "Orlof" method and the offset method.

The primary advantage of the machine and method of the present invention consists in that it permits of exploiting simultaneously two totally different methods for printing in a single pass, an offset image on one side and an "Orlof" image on the other side, thus offering the user for the first time the possibility of printing notably safety backgrounds on both sides of a bank note through two different methods: this increases the safety against forgery and in addition makes printing operations more economical because the user is not compelled to resort to two separate machines.

Another advantage of the present invention is that it is adapted to printing by at least two methods even on a single side. Additional printing units may be added on the "Orlof" or collect printing side of the machine to combine collect printing with wet offset and/or "intaglioset" (described below) printing. The offset side of the machine preferably employs a plurality of dry offset cylinders in combination with a wet offset or "intaglioset" cylinder. On a given side one printing method may be used for printing the safety background while the other is used for printing the main design.

It is another object of the present invention to provide a rotary multicolor indirect recto-verso printing machine, which permits to increase the number of colors transferred to at least one side of the paper in comparison with hitherto known machines, while affording at the same time the possibility of implementing on at least one side of the paper, as desired, the offset or collect printing method, completed by several additional offset printings, and permitting of changing from one method to the other in the simplest way.

The advantageous feature of this machine lies in the fact that up to, for example, six colors can be printed in perfect registration on one face of the paper by making either a six-color offset print or a collect print, for example of four or three colors, completed by an offset print of two or three colors. Such possibilities had never been achieved up to now with a single machine.

To achieve this result the essential fact is that the blanket cylinder, on which six colors are assembled, already receives several colors, for example four colors, via a convertible cylinder, as a multicolor design. If the convertible cylinder carries a smooth lining, notably a rubber blanket, and operates as a cylinder for transmitting the three-or four-color offset image, the layers thereof, during the transfer from one cylinder to another, are spread on the cylinders involved and are somewhat flattened; thus, the multicolor image transferred to the blanket cylinder assembling the six colors will constitute an ink layer of nearly normal thickness, on which two or three other layers constituting each other partial images will further be superposed. Thus, in the case of a six-color print, only one superposition of three of four layers of ink is formed on the blanket cylinder, on which said colors are assembled. The same reasoning is applicable in case the convertible cylinder carries the collect printing plate because the four colors are juxtaposed on this plate.

According to an advantageous structure of the machine, the cylinders are so arranged that the three blanket cylinders lie at least approximately in vertical mutual relationship and the path followed by the paper through the machine is at least approximately horizontal. In the case of a web fed printing machine and if the paper must be dried after the impression, it is possible to mount a drying device adjacent the machine, such that the web which cannot be guided by a roller can travel directly horizontally through this drying device.

According to another advantageous structure, the first two blanket cylinders are disposed horizontally in adjacent relationship, the convertible cylinder and the third blanket cylinder being disposed at least approximately in superposed relationship, the paper following a vertical path. With this arrangement, the access to the cylinders is facilitated and the peripheral space surrounding the second blanket cylinder is cleared, thus permitting to provide around this cylinder for example three plate cylinders if the diameter of the blanket cylinder and the diameter of the plate cylinders are in the ratio of 4:1.

Further objects and advantages of the present invention will become evident from the following detailed description to be read in conjunction with the drawings.

DESCRIPTION OF THE PREFERRED EMBODIMENTS

Figure 1:
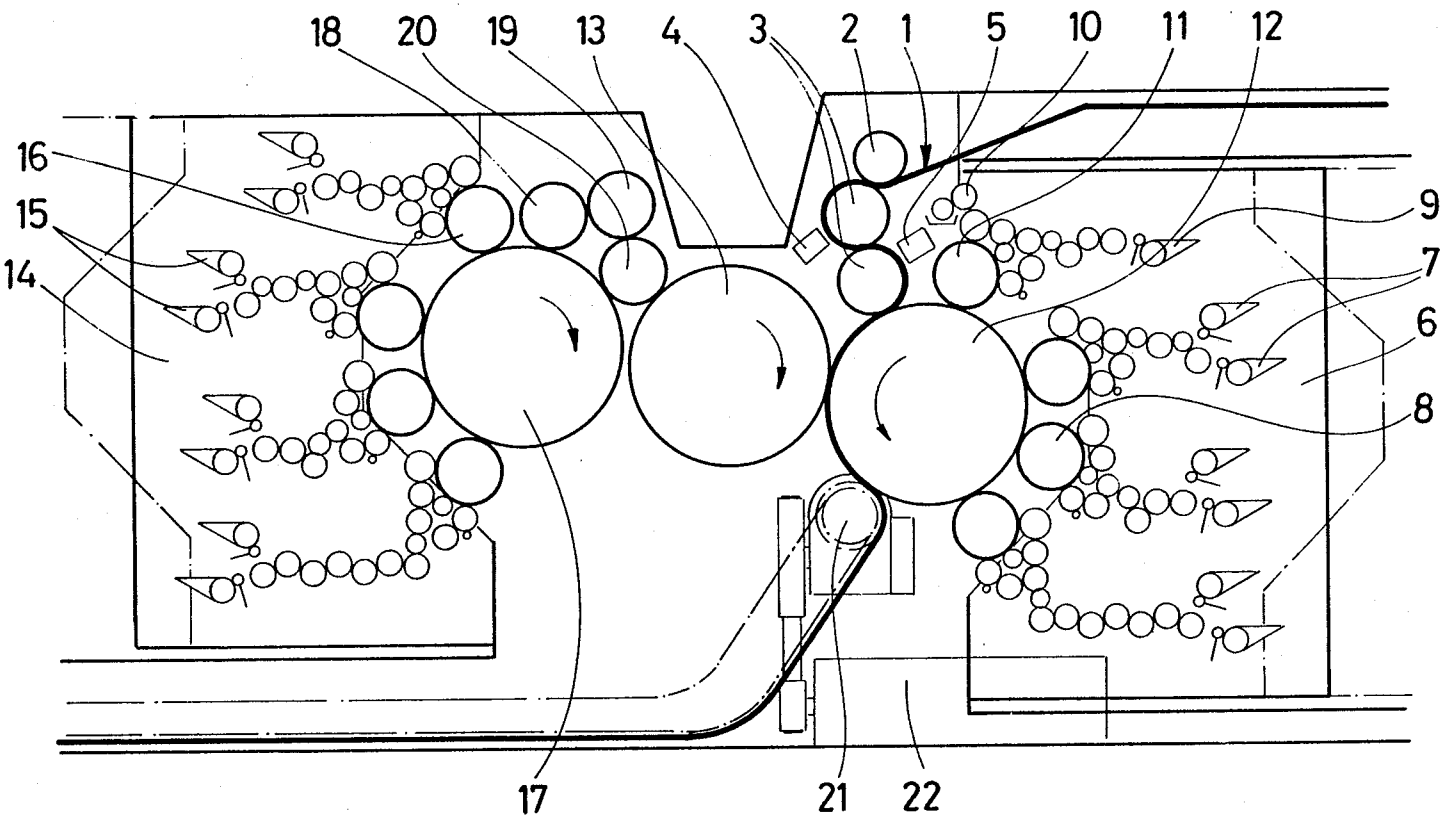
FIG. 1 illustrates diagrammatically a printing machine according to the invention.

The machine illustrated relates to a sheet printing machine and comprises an input device 1 for the paper in sheet form, which is provided with a stop drum 2, two transfer drums 3 provided with grippers, and dedusting and static electricity eliminators 4,5 installed on both sides of the paper 1. The sheets are transferred to a blanket cylinder 12 provided with grippers and pressed against another blanket cylinder 13 of same diameter. The sheets pass between blanket cylinders 12 and 13 and are printed simultaneously on both sides. The cylinders rotate in the direction shown by the arrows. After printing, the sheets are conveyed by a chain gripper system 21 and delivered to output piles or, if necessary, to another machine for completing the printing. The main motor of the machine is designated by reference numeral 22.

Figure 2:
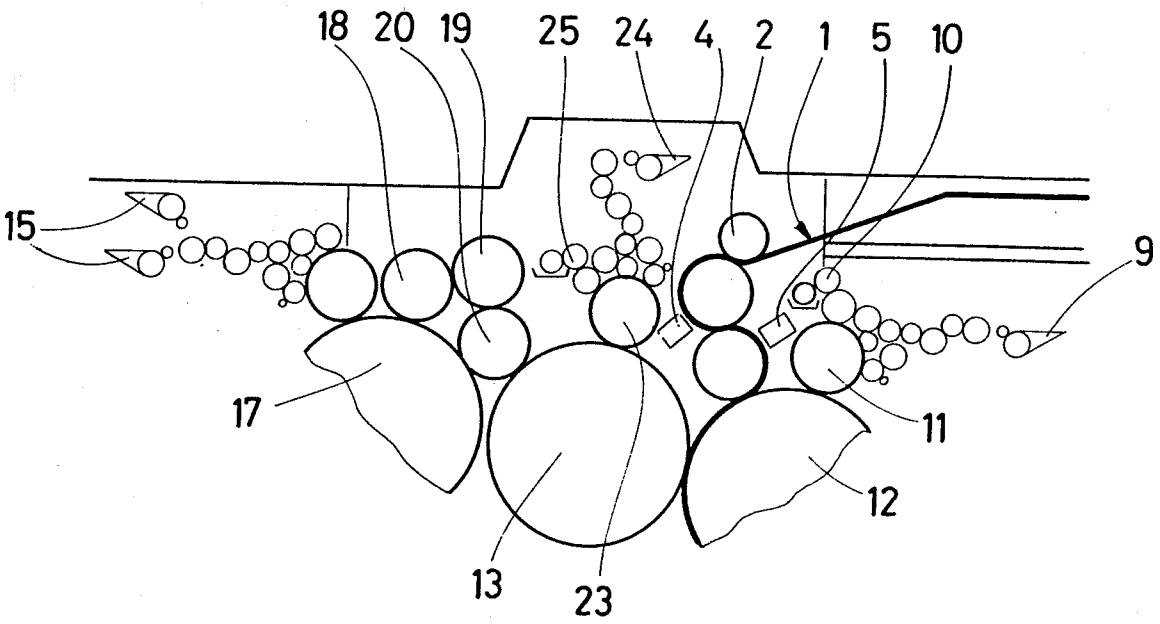
FIG. 2 illustrates diagrammatically, in fragmentary view, an extension of this machine completed by another wet offset printing unit.

The blanket cylinder 12 cooperates according to FIG. 1 with four offset plate cylinders 8 of which three, in the example discussed herein, are each provided with a dry offset printing plate each inked by an inking unit 7 with double ink duct, thus permitting the so-called iris printing. The dry offset printing plates are typographic plates known per se. The fourth offset plate cylinder 11 may carry a wet offset printing plate inked by an inking unit 9 with single ink duct provided with a dampening device 10. However, plate cylinder 11 may alternately carry an intaglio plate which is not wiped. The term "intaglioset" has been used for this operation. "Intaglioset" printing is described further in the specification with respect to plate cylinders 23 (FIG. 2). In any event, plate cylinder 11 is adapted to carry a plate giving another printing quality than the other dry offset plate cylinders. All inking units 7 and 9 are installed on a movable offset inking carriage 6.

These four plates of cylinders 8 and 11 represent partial designs which are inked in different colors and their number corresponds to the number of colors and designs of the first image to be printed on one side of paper 1. This image is notably a safety background in the case of fiduciary documents, notably bank notes.

These partial designs in different colors are combined on the blanket cylinder 12 acting as an offset blanket cylinder, therefore as a collecting cylinder for the partial designs constituting the multicolor image. This image is transferred to one side of the paper, in the example concerned on the back side, where a three-color dry offset printing is obtained and completed by a monochrome wet offset printing, preferably by means of an intaglio plate.

In the case of fiduciary documents one may also use the three dry offset plate cylinders 8 for creating a three-color background, whereas the plate cylinder 11 carries an intaglio plate that represents a main design.

Of course for the offset printing method all the four plate cylinders can be provided with dry offset plates or wet offset plates.

On the other side of the machine the elements necessary for printing an "Orlof" image are disposed. These elements comprise a blanket cylinder 17 having the same diameter as blanket cylinders 12 and 13. This blanket cylinder 17 cooperates in the example illustrated with four plate cylinders 16 carrying selective color inking plates having relief areas cut according to the contours of the areas to be printed in the respective color, they are each linked in this color by means of an inking device 15 with double ink duct, which are installed on an "Orlof" movable inking carriage 14. These selective color inking plates are made preferably of hard material not prone to undergo any distortion even if the relief is very fine, thus permitting of obtaining a safety background consisting of very fine color areas. The areas of the four colors are transferred to the blanket cylinder 17 operating as a collecting cylinder on which they are combined and by which they are transferred to a plate cylinder 20 carrying a typographic printing plate contacting said collecting cylinder and also blanket cylinder 13. This typographic plate represents the complete design of the second image to be printed in four colors on the other side of the paper. The complete image inked in the different colors is transferred in turn to blanket cylinder 13 for applying the printing of the complete image, notably a safety background, to the front side of the paper, of which the back side receives simultaneously the offset image. During the simultaneous printing the two cylinders 12 and 13 act mutually as counter-pressure cylinders.

The machine further comprises a first image transfer cylinder 18 and a second image transfer cylinder 19 both adapted to transfer the same image from the colored areas of blanket cylinder 17 in perfect registration to the typographic plate cylinder 20, thus permitting of reinforcing the inking of the typographic plate in the desired colors and therefore of better covering these areas with the desired ink. In fact, considering the direction of rotation of blanket cylinder 17, one fraction of the ink is transferred by cylinders 18 and 19 to the typographic plate cylinder 20 whereas the remaining fraction of the ink is transferred in perfect registration directly to this cylinder 20. The arrangement of the cylinders involved for obtaining this double inking is known (U.S. Pat. No. 4,441,423), the second inking being shifted by the length of the periphery of the typographic plate cylinder 20 or, in the example considered herein, by one-third of the periphery of blanket cylinder 17 because the latter has a diameter three times greater than the diameter of cylinder 20 and carries three blankets.

To meet this registration requirement, the arrangement of cylinders 17, 18, 19 and 20 is such that the sum of the arc lengths measured on the peripheries of cylinders 18, 19 and 20 between the respective points of contact-as seen in the direction of rotation of these cylinders must-be equal to the arc length measured on the periphery of cylinder 17 between the points of contact of this cylinder with cylinders 18 and 20, plus ⅓rd of the periphery of this cylinder 17.

If the design carried by the typographic plate for the "Orlof" printing consists only of lines, therefore of very narrow inked areas, the image transfer cylinders 18 and 19 may be dispensed with and merely a single inking of the "Orlof" typographic plate may be accomplished.

In the example illustrated the ratio of the diameters of cylinders 8, 11, 16, 18, 19 and 20, on the one hand, to the diameters of cylinders 12, 13 and 17, on the other hand, is 1:3; therefore, since the periphery of cylinders 12, 13 and 17 corresponds to three paper sheets, these cylinders carry each three blankets.

In the example of FIG. 2 the printing according to the "Orlof" method is completed by a wet offset printing also performed when the paper passes between blanket cylinders 12 and 13, which serves notably for printing a monochrome main design of currency paper. The wet offset unit comprises a plate cylinder 23 provided with an inking unit 24 and a dampening device 25, both known per se, this plate cylinder 23 cooperating with blanket cylinder 13 that transfers the image of the paper. Therefore, in this case there is obtained in a single pass on the front side a complete printing for example the four-color safety background by printing according to the "Orlof" method and the monochrome main design by printing according to the wet offset method, whereas the back side receives the four color safety background by an offset printing or a three-color background and also a monochrome main design by wet offset printing.

The plate cylinder 23 can preferably carry an intaglio plate, as described in relation to plate cylinder 11, or a dry offset or typographic plate. When an intaglio plate is used on cylinder 23, a special operation described in U.S. Pat. No. 4,036,130 is used. This operation is referred to as "intaglioset" printing. The intaglio plate is not wiped, but is treated as a wet offset plate. In this case the engraved lines contact (as in a wet offset plate) of an ink accepting and water repelling material, while the surface outside the engraved lines is of water accepting material which is moistened so that it does not accept ink when in contact with the inking rollers of inking unit 24. This "intaglioset" unit delivers an intaglio image (with a small relief) different in quality from offset or Orlof printing images. A great advantage is derived in that it can print the main design of a bank note of the "Orlof" or collect printed side so that this side of the bank note receives a complete print, consisting of a four-color safety background (by "Orlof" printing) and a monochrome main design (by "intaglioset" printing).

The additional printing device 23, 24 and 25 is preferably mounted in such a manner that it can be spaced away from blanket cylinder 13 into a rest position if no additional print is wanted.

The above described machine can be used without any difficulty as a web printing machine by simply replacing the sheet conveyor means with means for conveying a web of paper passing between blanket cylinders 12 and 13.

Figure 3:
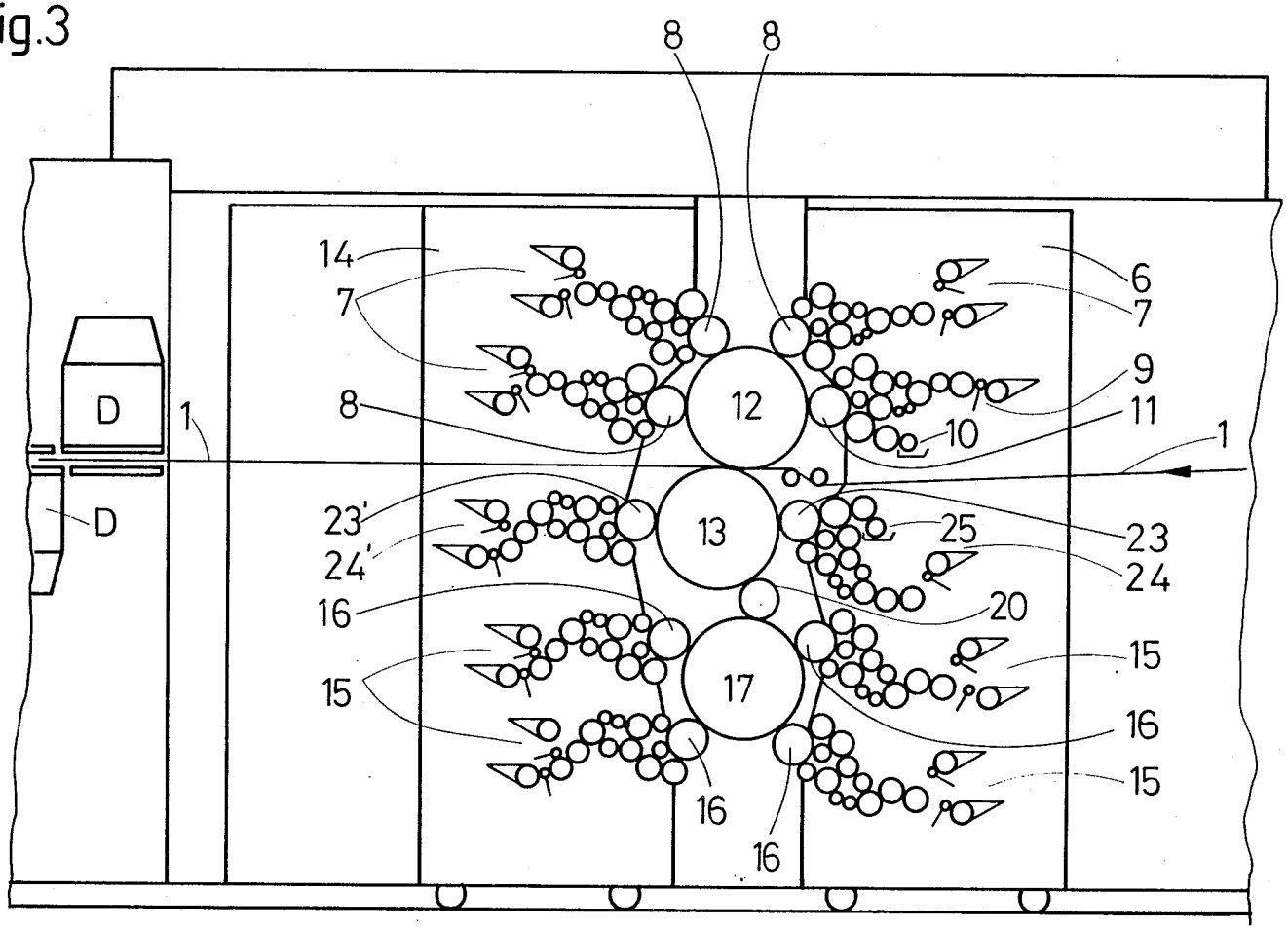
FIG. 3 illustrates diagrammatically a printing machine according to a second embodiment of the present invention having the three blanket cylinders disposed vertically.

FIG. 3 illustrates a second embodiment of the present invention. The operation of this machine which is a web fed machine, is substantially identical with the machine of FIGS. 1 and 2.

Blanket cylinders 12, 13 and 17 are mounted vertically, one upon the other. In this geometry paper web 1 is run horizontally. The paper web can therefore pass directly (without being carried by guiding rollers) to a drying device D. Blanket cylinder 12 again cooperates with three offset plate cylinders 8, which preferably are provided with dry offset printing plates. Plate cylinders 8 are again each linked by an inking unit 7 with a double ink duct. The fourth plate cylinder 11 which is inked by an inking unit 9 may carry a wet offset printing plate, or an intaglio printing plate which is not wiped as discussed with reference to FIGS. 1 and 2, but which is moistened by a dampening device 10.

The present configuration enables the mounting of two additional printing units cooperating with blanket cylinder 13 and comprising a plate cylinder 23, respectively 23', an inking device 24, respectively 24' and a dampening device 25 at one side. Unit 23, 24 and 25 is preferably an "intaglioset" unit while unit 23' and 24' is preferably a dry offset unit. Collect-inking blanket cylinder 17 cooperates with four plate cylinders 16, consisting of selective color inking cylinders inked by inking devices 15. The image is transferred from blanket cylinder 17 to typographic plate cylinder 20, representing the complete "Orlof" design to be printed, and then to blanket cylinder 13.

Blanket cylinders 12, 13 and 17 and all plate cylinders are housed in the main frame structure of the machine. Inking devices 9 and 24, one inking device 7, and two collect inking devices 15 are installed on the right-hand movable inking carriage 6 and all other inking devices on the left-hand movable inking carriage 14. Image transfer cylinders 18 and 19 are deleted in this embodiment.

The upper portion of the machine is therefore an offset printing machine having however the pecularity that all the plate cylinders 8 and 11 disposed on the two sides assist in printing the same upper paper side with a four-color offset image. All other plate cylinders and inking devices on both sides serve for printing the lower paper side, which receives a combined six-color Orlof-offset-image transferred from blanket cylinder 13. Of this six-color image, four colors constitute an "Orlof"

image with juxtaposed colors representing only one layer of ink of normal thickness; the other two colors from plate cylinders 23,23' are superposed to this "Orlof" image in the fashion of an offset print. Therefore, the maximum ink thickness on blanket cylinder 13 will correspond to three ink layers.

In the example illustrated in FIG. 3, the diameter of blanket cylinders 12, 13, 17 and the diameter of the plate cylinders and that of the cylinder 20 are in the ratio of 3:1.

Figure 3A:
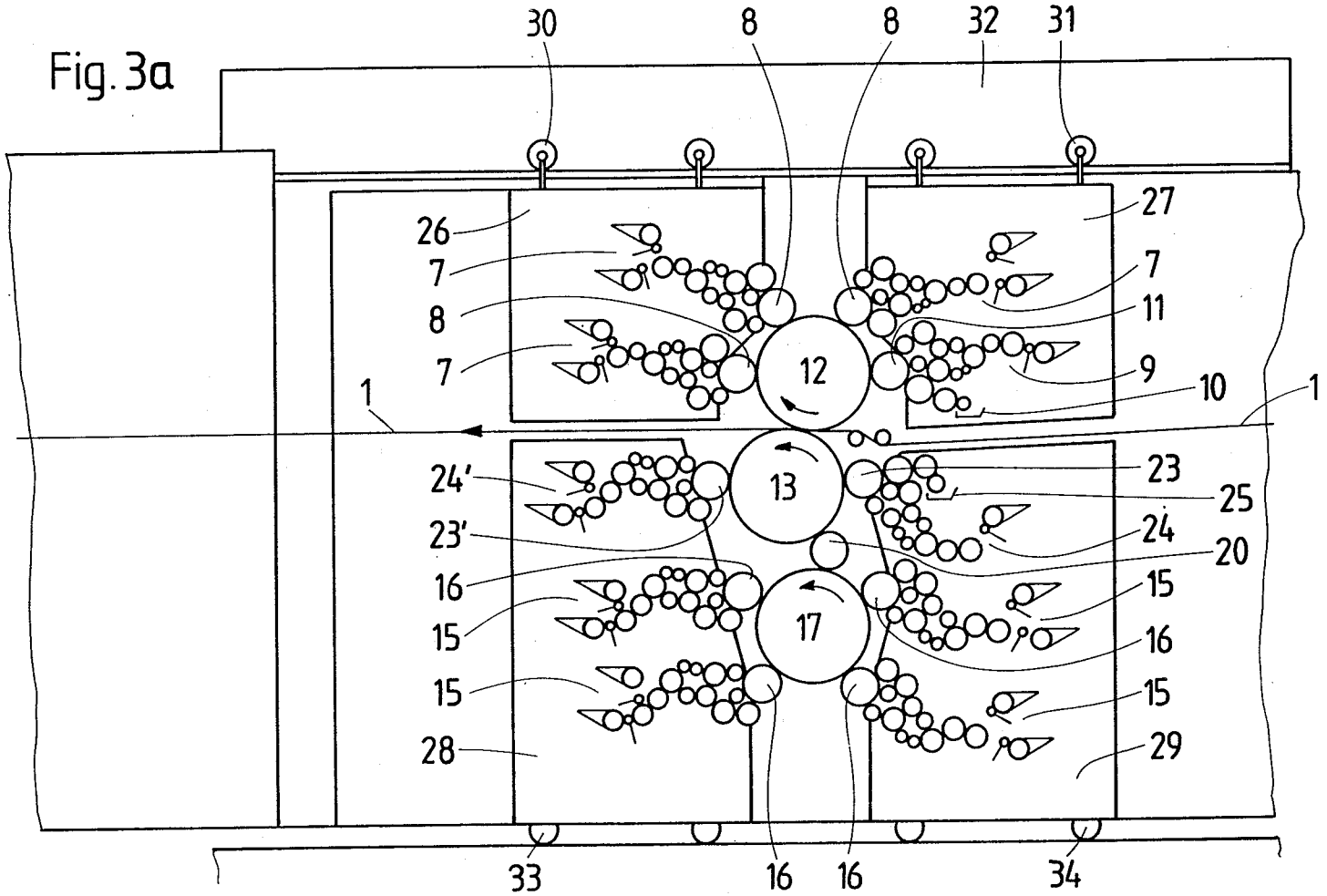
FIG. 3*a* illustrates diagrammatically a modification of the machine of FIG. 3.

In the form of embodiment illustrated in FIG. 3*a*, the elements and the general configuration of the machine are identical with the configuration of FIG. 3, the only difference consists in another arrangement of the inking devices that are disposed symmetrically on either side on four movable carriages.

Two inking devices 7 are mounted on a movable carriage 26 and the third inking device 7 and the inking device 9 being mounted on a movable carriage 27. Both movable carriages 26, 27 are suspended on both sides of blanket cylinder 12 by means of rollers 30, 31 respectively, from a horizontal beam 32 of the main frame structure. The inking device 24' and two inking devices 15 are installed on a movable carriage 28 disposed beneath the movable carriage 26 and rolling on rollers 33, whereas the inking device 24 and the two other inking device 15 are installed on a movable carriage 29 disposed beneath the movable carriage 27 and rolling on rollers 34. Thus, the peculiar feature is that all the elements carried by the two carriages 28 and 29, as well as the corresponding plate cylinders on either side of blanket cylinders 13, 17, are utilized for printing a multiclor image on the same side of the paper, whereas the elements carried by the two upper carriages 26 and 27 and the corresponding plate cylinders are utilized for printing a multicolor image on the other side of the paper.

Figure 4:
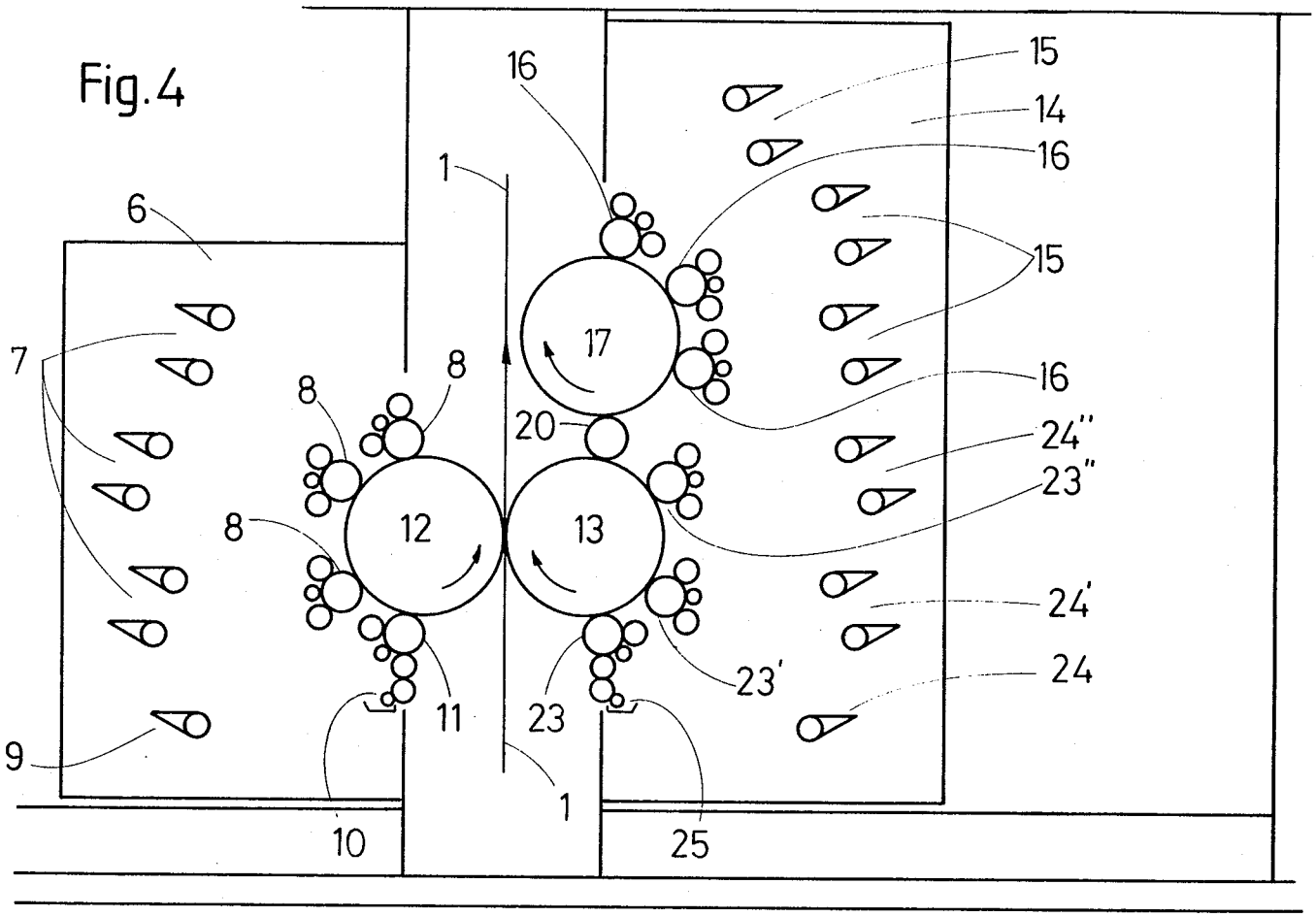
FIG. 4 illustrates diagrammatically a printing machine according to a third embodiment of the present invention.

FIG. 4 illustrates a third embodiment of the invention. The elements of the machine, which is also a web fed machine, operate in the same manner as described above. However the two blanket cylinders 12 and 13 are disposed horizontally, adjacent to each other, whereas the blanket cylinder 17 and the cylinder 20 are superposed at least approximately vertically, above the blanket cylinder 13. The paper 1 follows an at least approximately vertical path. According to this arrangement, the blanket cylinders are more easily accessible for cleaning and maintenance and a greater portion of the peripheral surface of cylinder 13 is available for installing more plate cylinders. Regarding the disposition of the inking devices, only the ink ducts proper and the inking rollers contacting the plate cylinders are illustrated, while eliminating all the intermediary rollers.

As in the other forms of embodiment, the first blanket cylinder 12 printing one face of paper 1 cooperates with four plate cylinders 8, 11 each inked by an inking device 7 with double ink duct, and by an inking device 9 with single ink duct for plate cylinder 11 provided with a dampening device 10. These inking devices are mounted on a movable inking carriage 6. The blanket cylinder 13 cooperates with three plate cylinders 23, 23', 23'' provided with their respective inking devices 24, 24', 24'', the inking device 24 being completed by a dampening device 25 for plate cylinder 23. The blanket cylinder 17 cooperates with three selective color inking cylinders 16 inked by their inking devices 15. The inking devices 24, 24', 24'' and 15 are mounted on another movable inking carriage 14. The diameter of blanket cylinders 12, 13 and 17 and the diameter of the plate cylinders and of the cylinder 20 are in the ratio of 4:1. If necessary, at least one of blanket cylinders 13 or 17 could also be inked by four plate cylinders, therefore with four colors.

The functions of these various elements are identical with those described with reference to FIGS. 1, 2 and 3.

All the plate cylinders cooperating with blanket cylinders 12 and 13 can be equipped with dry or wet, or partly with dry, partly with wet offset plates. Preferably, plate cylinders 11 and 23 or at least one of them, carry an intaglio plate having its surface wetted in the fashion of a wet offset plate by a dampening device 10 respectively 25 and forming an intaglioset unit. The quality of this intaglio printing is suitable for creating a main design on banknotes.

When printing banknotes, the safety backgrounds may thus be printed on both sides in four, respectively six colors. If intaglio printing plates representing each a main design are used on plate cylinders 11 and 23 a complete print is obtained with a background of three, respectively five colors and the monochrome main design. This is adequate for banknotes of smaller value for which a monochrome main design is deemed to be sufficient. For printing main multicolor designs, the banknotes are subsequently fed to another printing machine, notably an intaglio printing machine.

In all embodiments of the present invention the machine can be convertible. As shown in the drawings and described hitherto cylinder 20 is an Orlof (typographic) plate cylinder and the machine is working according to its first mode of operation producing a multicolor offset print on the one paper side and an Orlof or a combined Orlof-offset print on the other paper side.

To convert the machine, typographic plate cylinder 20, which is now a convertible cylinder, is converted to or replaced by an image transfer cylinder having a smooth surface, preferably by a blanket cylinder, and plate cylinders 16 of the Orlof part are converted to or replaced by offset plate cylinders, preferably dry offset plate cylinders. This can be simply effected by replacing the typographic plate on cylinder 20 by a rubber blanket, if this typographic plate is sufficiently thin, and by replacing the selective color inking plates on plate cylinders 16 by dry offset plates.

According to this second mode of operation, in the machine of FIG. 3, the four-color offset image assembled on blanket cylinder 17 is transferred via cylinder 20 to blanket cylinder 13 on which two other offset images are added by plate cylinders 23, 23', thus providing a six-color offset image printed on the lower face of the paper 1. Since the four-color image of blanket cylinder 17 does not represent anymore, after its transfer to the cylinder 20, four normal superposed layers but, due to the spreading and flattening caused by this transfer, has nearly the equivalent of the thickness of a single layer, there is no inconvenience in adding two other layers.

If the machine of FIG. 4 is working according to the second mode of operation, the three-color offset image assembled on blanket cylinder 17 is transferred via cylinder 20 to blanket cylinder 13 and completed by another three-color offset image from plate cylinders 23, 23', 23'', thus providing again a six-color offset image on one face of paper 1, while the other face receives simultaneously a four-color offset image.

In the three forms of embodiment described hereinabove, the passage of the paper web could be reversed without bringing any change in the machine, except for the position of the drying device. Moreover, these machines could be sheet printing machines and in this case guide members should be provided for the sheets and one of the blanket cylinders 12 or 13 should be provided with grippers for gripping the sheets.

Finally, a second convertible cylinder similar to cylinder 20 and cooperating with the first blanket cylinder 12 could be provided, together with a fourth blanket cylinder similar to cylinder 17, in order to have the possibility of making a six-color print also on the other side of the paper. In this case, the completed machine of FIG. 4 would comprise two symmetrical halves.

What is claimed is:

1. Rotary multicolor printing machine for the simultaneous printing of both sides of a paper in web or sheet form, more particularly for printing the safety background of fiduciary documents, which comprises a first blanket cylinder contacting a plurality of offset plate cylinders each inked by an inking device in a different color, the number of said offset plate cylinders corresponding to the number of colors and designs of the first image to be printed on one side of the paper, said first image consisting of superposed colors and designs, and comprising a second blanket cylinder operating as a color collecting cylinder contacting a plurality of selective color inking cylinders and a typographic plate cylinder, said typographic plate representing the complete design of the second image to be printed on the other side of the paper, said selective color inking cylinders, of which the number corresponds to the number of colors of said second image and wherein the relief areas correspond to the portions of this image to be colored in the different colors, being each linked by an inking unit in a different color and applying an image with juxtaposed colors to said collecting cylinder inking in turn said typographic plate cylinder, a third blanket cylinder, contacting said typographic plate cylinder and receiving therefrom the image with juxtaposed colors, said third blanket cylinder having the same diameter as said first blanket cylinder, and being pressed against said first blanket cylinder, said paper passing between said first and third blanket cylinders so as to be printed simultaneously on both sides with said first and second images, respectively; further comprising at least one additional printing unit, the plate cylinder thereof contacting the third blanket cylinder.

2. Machine according to claim 1 wherein the plate cylinder of the additional printing unit carries an intaglio printing plate which is not wiped.

3. Machine according to claim 1 wherein the plate cylinder of the additional printing unit carries an offset printing plate.

4. Machine according to claim 1 wherein at least one of the additional printing unit(s) is mounted so that it can be spaced from the third blanket cylinder into a rest position if no additional print is desired.

5. Machine according to claim 1 wherein the first, second and third blanket cylinders are mounted substantially vertically with respect to one another, two additional printing units being mounted to cooperate with the third blanket cylinder, a first additional unit mounted on one side of the third blanket cylinder and a second additional unit mounted on the other side of the third blanket cylinder, said paper passing horizontally between said first and third blanket cylinders so as to be printed simultaneously on both sides with said first and second images, respectively, completed by two additional color prints from said additional printing units.

6. A machine according to claim 5, wherein at least one of the additional printing units comprises an intaglio plate which is not wiped.

7. Machine according to claim 1 wherein the second and third blanket cylinders are mounted on a first side, with the second blanket cylinder being mounted substantially vertically above the third blanket cylinder, and the first blanket cylinder is mounted horizontally adjacent to and contacting the third blanket cylinder, three additional printing units are mounted to cooperate with the third blanket cylinder, and wherein the paper passes vertically between the first and third blanket cylinders, so as to be printed simultaneously on both sides with said first and second image, respectively, completed by a plurality of additional color prints from said additional printing units.

8. A machine according to claim 7, wherein at least one of the additional printing units comprises an intaglio plate which is not wiped.

9. Rotary multicolor indirect printing machine for simultaneous recto-verso printing, more particularly for printing the safety background of fiduciary papers and notably banknotes, comprising a first blanket cylinder cooperating with a plurality of plate cylinders each inked by its own inking device; a second blanket cylinder cooperating with a plurality of plate cylinders each inked by its own inking device; a third blanket cylinder pressed against said first blanket cylinder and operating with at least one plate cylinder inked by its own inking device; a convertible cylinder that is convertible into a plate cylinder or an image transfer cylinder, said convertible cylinder contacting said second and said third blanket cylinders, the paper being fed between said first and said third blanket cylinders; the diameter of the three blanket cylinders being a whole multiple of the diameter of said convertible cylinder and of said plate cylinders, whereby:

in a first mode of operation, the plate cylinders cooperating with said second blanket cylinder carry selective color inking plates and the convertible cylinder carries a collect printing plate, and in a second mode of operation, said last mentioned plate cylinders carry offset printing plates and said convertible cylinder is an image transfer cylinder having a smooth layer for transferring the offset image from said second to said third blanket cylinder.

10. Printing machine of claim 9 wherein the three blanket cylinders are disposed at least substantially vertically one above the other, the path of the paper through the machine being at least substantially horizontal.

11. Printing machine of claim 10 wherein all the inking devices are disposed on two pairs of movable superposed inking carriages on either side of the blanket cylinders, the lower carriages carrying the inking devices for printing one side of the paper, the upper carriages carrying the inking devices for printing the other side of the paper.

12. Printing machine of claim 10 wherein the inking devices are disposed on two movable inking carriages on either side of the blanket cylinders, each carriage carrying both the inking devices for printing one portion of the image on one side of the paper and the inking device for printing one portion of the image on the other side of the paper.

13. Printing machine according to claim 9 preferably a web fed printing machine, wherein the first and the third blanket cylinders are disposed horizontally, adjacent to each other, the third blanket cylinder, the convertible cylinder and the second blanket cylinder being disposed at least approximately vertically in mutual superposed relationship, the path followed by the paper being at least approximately vertical.

14. Printing machine according to claim 13 wherein the inking devices associated with the first blanket cylinder are disposed on a first movable inking carriage and the inking devices associated with the other two superposed blanket cylinders are disposed on another movable inking carriage.

15. Printing machine according to claim 13 wherein the two blanket cylinders engaging the convertible cylinder are each inked by at least three plate cylinders.

16. Printing machine according to claim 9 wherein at least one of said plate cylinders, preferably one of the plate cylinders cooperating with the first blanket cylinder and one of the plate cylinders cooperating with the third blanket cylinder, carries an intaglio printing plate moistened by a dampening device.

17. A method of printing for the simultaneous printing of both sides of a paper in web or sheet form, particularly for printing fiduciary documents, each side being printed by a different method, comprising the steps of:

providing first, second and third blanket cylinders, the first blanket cylinder contacting a plurality of offset plate cylinders, the second blanket cylinder operating as a color collecting cylinder and contacting, on one side, a plurality of color selective inking cylinders and contacting on the other side a typographic plate cylinder also in contact with the third blanket cylinder, the third blanket cylinder contacting the first blanket cylinder, pressing paper between the first and the third blanket cylinders;

printing a first side of the paper by offset printing; simultaneously printing on a second side of the paper by collect printing wherein a safety background design is printed by contacting a plurality of selective color inking cylinders to the second blanket cylinder, which in turn inks a typographic plate cylinder which transfers an image to the third blanket cylinder and wherein a main design is printed on the second side of the paper by contacting the third blanket cylinder with at least one additional printing unit.

18. A method according to claim 17 further comprising printing on the first side of the paper a safety background design and a main design, the safety background design being printed by contacting a plurality of dry offset plate cylinders to the first blanket cylinder, the main design being printed by a wet offset, notably using an intaglio printing plate which is not wiped.

19. A method according to claim 17 wherein the at least one additional printing unit comprises a wet offset, notably using an intaglio printing plate which is not wiped.

20. A method according to claim 17 comprising movably mounting the at least one additional printing unit so that it may be moved out of contact with the third blanket cylinder to a rest position.

21. A method according to claim 17 wherein the three blanket cylinders are mounted substantially vertically, comprising contacting the third blanket cylinder with at least two additional printing units and passing the paper, after printing, directly to a drying unit.

22. A method according to claim 17 wherein the three blanket cylinders are arranged so that the second blanket cylinder is mounted substantially vertically above the third blanket cylinder and the first blanket cylinder is mounted horizontally adjacent to the third blanket cylinder, comprising contacting the third blanket cylinder with at least three additional printing units, whereby preferably at least one of said at least three additional printing units including printing by wet offset, notably using an intaglio plate which is not wiped.

* * * * *